United States Patent [19]

Fernley et al.

[11] 4,052,342

[45] Oct. 4, 1977

[54] SECONDARY ALKYL SULFATE: ALCOHOL ETHOXYLATE MIXTURES

[75] Inventors: George W. Fernley; Cecil M. Stone, both of Amsterdam, Netherlands

[73] Assignee: Shell Oil Company, Houston, Tex.

[21] Appl. No.: 657,805

[22] Filed: Feb. 13, 1976

[30] Foreign Application Priority Data

July 17, 1975 United Kingdom ..... 30037/75

[51] Int. Cl.[2] .... C11D 1/14; C11D/1/29; C11D/1/68; C11D/1/87

[52] U.S. Cl. ..... 252/541; 252/89 R; 252/531; 252/545; 252/550; 252/551; 252/DIG. 1

[58] Field of Search ..... 252/121, 531, 532, 550, 252/551, 89, DIG. 1, 523, 526, 541, 545

[56] References Cited

U.S. PATENT DOCUMENTS

| | | | |
|---|---|---|---|
| 3,234,258 | 2/1966 | Morris | 252/550 X |
| 3,468,805 | 9/1969 | Grifo | 252/550 X |
| 3,793,233 | 2/1974 | Rose | 252/547 |
| 3,868,336 | 2/1975 | Mazzola | 252/527 |
| 3,925,224 | 12/1975 | Winston | 252/89 |

*Primary Examiner*—Dennis L. Albrecht

[57] ABSTRACT

Detergent compositions comprising low crystalline fraction secondary alkyl sulphates derived from $C_{10}$-$C_{18}$ olefins and alcohol ethoxy sulphates and/or alcohol ethoxylates have good detergency properties.

3 Claims, No Drawings

SECONDARY ALKYL SULFATE: ALCOHOL ETHOXYLATE MIXTURES

BACKGROUND OF THE INVENTION

1. Field of the Invention

This invention is concerned with detergent compositions comprising olefin derived secondary alkyl sulphates and alcohol ethoxy sulphates and/or alcohol ethoxylates.

2. Description of the Prior Art

The invention is concerned with detergent compositions comprising secondary alkyl sulphates derived from olefins.

Secondary alkyl sulphates, usually in the form of alkali-metal, ammonium or amine salts, may be derived from both olefins and alcohols using sulphuric acid, followed by neutralization with the appropriate base, although olefin-derived secondary alkyl sulphates have not been so extensively investigated as alcohol-derived secondary alkyl sulphates, because the preparation of the former is usually more difficult than the preparation of the latter. The only olefin-derived secondary alkyl sulphate which has achieved a significant commercial success is "Teepol" 10 ("Teepol" is a registered Trade Mark) which is derived from sulphation and neutralization of $C_8$ to $C_{18}$ $\alpha$-olefins. Although this product has been commercially available for about 30 years it has not been extensively investigated as a component of house-hold products such as high-performance fabric and dish-washing compositions, because of its poor detergency although it has been used in industrial products either alone or in binary blends with alkylbenzene sulphonates.

The increased availability of narrower cuts, or single cuts, of both alpha- and internal olefins, in the $C_{10}$ to $C_{18}$ range, particularly in the $C_{11}$ to $C_{17}$ range, has renewed interest in olefin-derived secondary alkyl sulphates as components of house-hold products.

However, insofar as $C_{10}$ to $C_{18}$ internal olefins are concerned, the performance of the secondary alkyl sulphates derived therefrom, although better than that of secondary alkyl sulphates derived from $C_8$ to $C_{18}$ alpha-olefins, has proved disappointing.

Insofar as secondary alkyl sulphates derived from $C_{10}$ to $C_{18}$ alpha-olefins are concerned it has been found that the performance thereof depends on the structure of the resulting secondary alkyl sulphates. It is possible to prepare from these olefins, by using low reaction temperatures, such as temperatures of below 15° C, e.g. of between −5° C and 5° C, and/or low residence times such as times of below 10 minutes, e.g. of from 4 to 8 minutes, secondary alkyl sulphates in which the sulphate groups are predominately on the 2- and 3- carbon atoms of the alkyl chains (hereinafter referred to as high crystalline fraction) and the performance of these products is encouraging and is much better than the performance of secondary alkyl sulphates derived from $C_{10}$ to $C_{18}$ internal olefins.

It is also possible to prepare from these $C_{10}$ to $C_{18}$ alpha-olefins, by using higher reaction temperatures such as temperatures above 15° C, e.g. of between 25° and 35° C, and/or high residence times such as times above 10 minutes, e.g. of from 10 to 15 minutes, secondary alkyl sulphates in which the sulphate groups are more randomly distributed over the alkyl chains (hereinafter referred to as low crystalline fraction) but the performance of these products has also proved disappointing and is no better than secondary alkyl sulphates derived from $C_{10}$ to $C_{18}$ internal olefins. This equivalency in performance between low crystalline fraction secondary alkyl sulphates and secondary alkyl sulphates derived from $C_{10}$ to $C_{18}$ internal olefins results from the fact that the latter is also a low crystalline fraction, irrespectively of the reaction conditions such as the temperature, under which they are prepared, i.e. there is no predominance of 2- and 3-isomer content as in high crystalline fraction secondary alkyl sulphate.

SUMMARY OF THE INVENTION

This invention is based on the discovery that low crystalline fraction secondary alkyl sulphates may be blended with alcohol ethoxy sulphates and/or alcohol ethoxylates to produce high-performance detergent compositions, particularly dish-washing compositions, which are equivalent in performance to compositions containing high crystalline fraction secondary alkyl sulphates combined with alcohol ethoxy sulphates and/or alcohol ethoxylates although the low crystalline fraction secondary alkyl sulphates alone have poorer detergency properties than high crystalline fraction secondary alkyl sulphates.

DESCRIPTION OF THE PREFERRED EMBODIMENTS

The pesent invention is concerned with a detergent composition comprising:

a. a low crystalline fraction secondary alkyl sulphate derived from $C_{10}$ to $C_{18}$ olefins, and b. an alcohol ethoxy sulphate and/or c. an alcohol ethoxylate.

It will be appreciated by those workers knowledgeable in this field that a precise definition of low crystalline fraction secondary alkyl sulphates is not possible since there is no sudden transition point between low crystalline fraction and high crystalline fraction secondary alkyl sulphates. However, in general, secondary alkyl sulphates having less than 85%, particularly less than 80% and more particularly less than 70% of its sulphate groups on the 2- and 3- carbon atoms of the alkyl chains can be regarded as low crystalline field secondary alkyl sulphates whereas secondary alkyl sulphates having more than 70%, particularly more than 80%, and more particularly more than 85% of its sulphate groups on the 2- and 3- carbon atoms can be regarded as high crystalline fraction secondary alkyl sulphates. Another useful practical distinction insofar as secondary alkyl sulphates prepared from alpha-olefins are concerned are the reaction conditions under which the secondary alkyl sulphates are prepared and which are referred to above. Another useful distinction is also the Kraft point of the secondary alkyl sulphates. For a given carbon chain length the Kraft point will give information about the 2- and 3- isomer content; low Kraft points indicating low crystalline fraction secondary alkyl sulphates. For example, the Kraft point of a 30% active matter aqueous solution of $C_{14}$ to $C_{15}$ low crystalline fraction secondary alkyl sulphates (sodium salts) is 18° C whereas the Kraft point of a 30% active matter aqueous solution of $C_{14}$ to $C_{15}$ high crystalline fraction secondary alkyl sulphates (sodium salts) is 35° C.

Suitably the low crystalline fraction secondary alkyl sulphate component of the composition is in the form of a metal, ammonium or amine salt. Suitable metal salts are alkali-metal salts e.g. potassium or sodium salts.

These are formed from the reaction products of the olefins and $H_2SO_4$, i.e. secondary alkyl sulphuric acids, by known methods e.g. neutralization with KOH or NaOH. The low crystalline fraction secondary alkyl sulphates may be derived from mono-olefin cuts or mixtures of olefins; preferably the olefins are substantially (greater than 30%) linear. The olefins may be internal olefins or alpha-olefins. Suitable mixtures of olefins are mixtures of $C_{13}$ and $C_{14}$ internal olefins or $C_{14}$ and $C_{15}$ alpha-olefins. In general olefins in the range $C_{10}$ to $C_{18}$, particularly $C_{12}$ to $C_{17}$, and more particularly $C_{13}$ to $C_{16}$, are preferred.

Insofar as component (b) of the composition is concerned it is preferably an alcohol ethoxy sulphate such as the ethoxy sulphates of primary or secondary straight-chain or branched alcohols, especially of alcohol mixtures. Suitably the alcohols have from 8 to 18 carbon atoms, although 12–18, 9–16, 9–13 and narrower cuts are also suitably used. Preferably the alcohols are primary and substantially straight-chain (i.e. contain less than 30% branching). Those obtained by the hydroformylation of olefins are most satisfactory. The ethoxy sulphates are prepared from such alcohols by firstly reacting them with ethylene oxide, suitably in an amount such so as to provide on average from 1 to 13, particularly 3 to 12, moles of ethylene oxide per mole of alcohol (or alcohol mixture). Commercially available alcohol ethoxylates have on the average 3, 7, 9 and 12 moles of ethylene oxide per mole of alcohol and are suitable for use although other average ratios are also suitable. The alcohol ethoxylates are then sulphated and neutralized.

Insofar as component (c) of the composition is concerned it is preferably an alcohol ethoxylate such as the ethoxylates derived by ethoxylation of primary or secondary, straight-chain or branched alcohols, especially of alcohol mixtures. Suitably, the alcohols have from 8 to 18 carbon atoms, although 12–18, 9–16, 9–13 and narrower cuts are also suitably used. Preferably the alcohols are primary and are substantially straight-chain (i.e. contain less than 30% branching) as are obtained by the hydroformylation of olefins. The amount of ethylene oxide used to prepare such ethoxylates is suitably such so as to provide on average from 1 to 13 moles of ethylene oxide per mole of alcohol (or alcohol mixture). Commercially available alcohol ethoxylates have on the average 3, 7, 9 and 12 moles of ethylene oxide per mole of alcohol and are suitable although other average ratios are also suitable.

The weight ratio of component (a) to component(s) (b) and/or (c) in the compositions may vary widely with weight ratios of from about 1:19 to about 19:1, particularly from about 1:4 to about 4:1, being preferred.

The compositions according to the present invention may also comprise components other than those specified above. Such additives include builders; sequestering agents; optical whitening agents; enzymes; perfumes; other non-ionic detergents, e.g. alkyl benzene sulphonates, olefin sulphonates and paraffin sulphonates; alkylphenol ethoxysulphates and alkylphenol ethoxylates; cationic detergents e.g. quaternary ammonium compounds; ampholytic detergents and foam promotors such as fatty acid alkanolamines.

The invention is further described by the following examples and illustrative embodiments which are provided for illustration and are not to be construed as limiting the invention.

EXAMPLE 1

This example illustrates the difference in performance between (a) secondary alkyl sulphates (SAS) prepared from alpha-olefins, in which the sulphate group is mainly positioned on the 2- and 3-atoms of the alkyl chain and (b) secondary alkyl sulphates also prepared from alpha-olefins, in which the sulphate group is more randomly distributed over the alkyl chain.

Secondary alkyl sulphates of type (a) were prepared from $C_{13}$, $C_{14}$, $C_{15}$, $C_{16}$ and $C_{17}$ alpha-olefins and conc. $H_2SO_4$ using low reaction temperatures (in the range of from $-5°$ to $+5°$ C) and low residence times (in the range of from 4 to 8 minutes). In all cases the sodium salts were prepared. It was established that more than 80% of the sulphate groups were positioned on the 2- and 3- carbon atoms of the alkyl chains (i.e. high crystalline fraction secondary alkyl sulphate).

Secondary alkyl sulphates of type (b) were prepared from the same olefins using higher reaction temperatures (in the range of from 25° to 35° C) and higher residence times (in the range of from 10 to 14 minutes). In all cases the sodium salts were prepared. For these products less than 70% of the sulphate groups were positioned on the 2- and 3- carbon atoms of the alkyl groups (i.e. low crystalline fraction secondary alkyl sulphates).

The foam performances of both types of secondary alkyl sulphates were evaluated by the following test. Plates, soiled with main course food were washed under standard conditions of detergent concentration 0.2 g/l, temperature (46° C) and water hardness (230 ppm, as $CaCO_3$), until the foam in the wash liquor was exhausted. The numbers of plates washed were counted and rated relative to standard detergent (which is rated as 100).

The results of the test are presented in Table 1 from which it can be seen that secondary alkyl sulphates of type (b) produce much poorer results than that of type (a).

Table 1

| Sulphate type | Olefin Type | | | | |
|---|---|---|---|---|---|
| | $C_{13}$ | $C_{14}$ | $C_{15}$ | $C_{16}$ | $C_{17}$ |
| (a) | 99 | 293 | 281 | 240 | 176 |
| (b) | 88 | 142 | 148 | 143 | 97 |

ILLUSTRATIVE EMBODIMENT 1

The secondary alkyl sulphates used in this Illustrative Embodiment were as follows:

a. Secondary alkyl sulphates (commercially available under the registered Trade Mark "Teepol" 10) prepared from a mixture of $C_8$ to $C_{18}$ alpha-olefins, b. Secondary alkyl sulphates prepared from a mixture of $C_{14}$ and $C_{15}$ (40:60) alpha-olefins and conc. $H_2SO_4$ using a reaction temperature of 0° C and a residence time of 6 minutes. More than 80% of the sulphate groups were positioned on the 2- and 3- carbon atoms of the alkyl chains. (i.e. high crystalline fraction secondary alkyl sulphates).

c. Secondary alkyl sulphates prepared from the same mixture of olefins as described under (b) and conc. $H_2SO_4$ but using a reaction temperature of 30° C and a residence time of 12 minutes. About 60% of the sulphate groups were positioned on the 2- and 3- carbon atoms of the alkyl chains. (i.e. low crystalline fraction secondary alkyl sulphates).

d. Secondary alkyl sulphates prepared from a mixture of $C_{13}$ and $C_{14}$ (50:50) internal olefins and conc. $H_2SO_4$ using a reaction temperature of 30° C and a residence time of 12 minutes. Again about 60% of the sulphate groups were positioned on the 2- and 3- carbon atoms of the alkyl chaines (low crystalline fraction secondary alkyl sulphates).

In all cases the sodium salts were prepared.

The above secondary alkyl sulphates and mixtures of secondary alkyl sulphates of types (b), (c) and (d) with a $C_9$ to $C_{11}$ primary substantially straight-chain alcohol ethoxylate, average 8 moles of EO/mole of alcohol (commercially available as "Dobanol" 91-8EO; "Dobanol" is a registered Trade Mark) prepared by hydroformylating and ethoxylating a mixture of $C_8$ to $C_{10}$ olefins, were tested for their dish-washing performance.

The dish-washing test comprises washing plates soiled with main course food under standard conditions of detergent concentration (0.2 g/l), temperature (46° C) and water hardness (300 ppm, as $CaCO_3$) until the foam is exhausted. The number of plates washed before exhaustion of foam is recorded.

The numbers of plates washed are presented in Table 2 from which it can be seen that the formulations based on secondary alkyl sulphates of types (c) and (d) perform equivalently to secondary alkyl sulphates of type (b) in spite of the much worse results of secondary alkyl sulphates of types (c) and (d) alone when compared with secondary alkyl sulphates of type (b) alone. The result for secondary alkyl sulphates of type (a) alone shows that its performance is not good enough to be considered as a possible component of dish-washing formulations.

Table 2

| SAS | SAS: "Dobanol" 91-8EO wt. ratio | | | |
|---|---|---|---|---|
| type | 100/0 | 75/25 | 50/50 | 0/100 |
| (a) | 4 | — | — | — |
| (b) | 12 | 17 | 17 | 8 |
| (c) | 8 | 17 | 17 | 8 |
| (d) | 8 | 17 | 17 | 8 |

ILLUSTRATIVE EMBODIMENT 2

Illustrative Embodiment 1 was repeated with the difference that the alcohol ethoxylate was replaced by a sodium $C_{12}$ to $C_{15}$ primary substantially straight chain alcohol ethoxy (average 3 moles of EO/mole of alcohol) sulphate (commercially available as "Dobanol" 25-3S) prepared by hydroformylating, ethoxylating, sulphating and neutralizing a mixture of $C_{11}$ to $C_{14}$ olefins.

The number of plates washed are presented in Table 3 from which it can be seen that the same conclusions as stated in Example 2 may be made.

Table 3

| SAS | SAS: "Dobanol" 25-3S wt. ratio | | | |
|---|---|---|---|---|
| type | 100/0 | 75/25 | 50/50 | 0/100 |
| (a) | 4 | — | — | — |
| (b) | 12 | 22 | 24 | 23 |
| (c) | 8 | 22 | 24 | 23 |
| (d) | 8 | 22 | 24 | 23 |

ILLUSTRATIVE EMBODIMENT 3

Illustrative Embodiment 1 and 2 were repeated using different weight ratios of the components as well as using mixtures of "Dobanol" 25-3S and "Dobanol" 91-8EO. The number of plates washed are presented in Table 4.

Table 4

| SAS | wt. ratio | | | |
|---|---|---|---|---|
| type | SAS | "Dobanol" 25-3S | "Dobanol" 91-8EO | Plates |
| (b) | 60 | 40 | — | 25 |
| (c) | 60 | 40 | — | 25 |
| (b) | 60 | — | 40 | 20 |
| (c) | 60 | — | 40 | 21 |
| (b) | 60 | 20 | 20 | 23 |
| (c) | 60 | 20 | 20 | 24 |
| (b) | 50 | 25 | 25 | 22 |
| (c) | 50 | 25 | 25 | 24 |

We claim as our invention:

1. A detergent composition consisting essentially of a first component selected from the group consisting of a potassium, sodium, ammonium and amine salt of a low crystalline fraction secondary alkyl sulfate derived from $C_{13}$ to $C_{15}$ olefins having less than about 70% of the sulfate groups on the 2- and 3- carbon atoms and a second component consisting of $C_9$ to $C_{11}$ alcohol ethoxylates containing on the average eight moles of ethylene oxide per mole of alcohol prepared by hydroformylating and ethoxylating a mixture of $C_8$ to $C_{10}$ olefins and wherein the weight ratio of said first component to said second component ranges from about 3:1 to about 1:1.

2. The composition of claim 1 wherein about 60% of the sulfate groups are positioned on the 2- and 3- carbon atoms and the weight ratio of said first component to said second component is about 3:1.

3. The composition of claim 1 wherein about 60% of the sulfate groups are positioned on the 2- and 3- carbon atoms and the weight ratio of said first component to said second component is about 1:1.

* * * * *